US008575523B2

(12) United States Patent
Chivers et al.

(10) Patent No.: US 8,575,523 B2
(45) Date of Patent: Nov. 5, 2013

(54) PLANAR HEATING ELEMENT FOR UNDERFLOOR HEATING

(75) Inventors: Edward Chivers, Oak Bluff (CA); Normal L. Loewen, Oak Bluff (CA); Jonathan Willner, Oak Bluff (CA); Robert P. Amborsky, Winnipeg (CA)

(73) Assignee: Innovative Heating Technologies Inc, Oak Bluff, MB (CA)

( * ) Notice: Subject to any disclaimer, the term of this patent is extended or adjusted under 35 U.S.C. 154(b) by 1163 days.

(21) Appl. No.: 12/416,245

(22) Filed: Apr. 1, 2009

(65) Prior Publication Data

US 2009/0266810 A1 Oct. 29, 2009

Related U.S. Application Data

(60) Provisional application No. 61/047,916, filed on Apr. 25, 2008, provisional application No. 61/146,196, filed on Jan. 21, 2009.

(51) Int. Cl.
*H05B 3/03* (2006.01)
*H05B 3/36* (2006.01)

(52) U.S. Cl.
USPC ..... 219/549; 219/213; 219/528; 219/541; 219/544; 219/548

(58) Field of Classification Search
None
See application file for complete search history.

(56) References Cited

U.S. PATENT DOCUMENTS 3,584,198 A * 6/1971 Doi et al. ..... 219/541
3,627,981 A * 12/1971 Kuhn ..... 219/212
3,697,728 A * 10/1972 Stirzenbecher ..... 219/548
4,141,187 A * 2/1979 Graves ..... 52/173.1
4,250,398 A * 2/1981 Ellis et al. ..... 219/549
4,656,339 A * 4/1987 Grise ..... 219/528
4,661,689 A * 4/1987 Harrison ..... 219/528
4,677,801 A * 7/1987 Bard ..... 52/389
4,725,717 A * 2/1988 Harrison ..... 219/528
5,408,069 A * 4/1995 Mischel, Jr. ..... 219/219
5,961,869 A 10/1999 Irgens
6,423,951 B1 * 7/2002 Elsasser ..... 219/541

(Continued)

FOREIGN PATENT DOCUMENTS

EP 0 209 224 1/1987
GB 2433185 6/2007

(Continued)

OTHER PUBLICATIONS

Easy Heat Warm Tiles literature—Copyright 2007 (2 pages) Anti-Fracture Membrane literature—Copyright 2007 (5 pages).

*Primary Examiner* — Joseph M Pelham
(74) *Attorney, Agent, or Firm* — Adrian D. Battison; Ade & Company Inc

(57) ABSTRACT

A heating element includes two flexible plastics layers connected in overlying relationship with first and second conductors each running along the element between the layers the side edges with a row of printed conductive strips at right angles to the conductors. A grounding layer comprising a sheet of foil laminated to a carrier is laminated to the heating element. A reinforcing layer in the form of a bitumen anti-fracture membrane is applied on one surface and a reinforcing layer of a fiber reinforced material is applied on the opposite surface for engagement into a tile adhesive layer. First and second strips of an electrically insulating material are applied over the first and second conductors to define slots allowing insertion into the slots of respective clamp type terminals.

19 Claims, 5 Drawing Sheets

(56) References Cited

U.S. PATENT DOCUMENTS

| | | | | |
|---|---|---|---|---|
| 6,426,489 | B1 * | 7/2002 | Elsasser | 219/543 |
| 7,488,523 | B1 | 2/2009 | Muncaster et al. | |
| 7,804,044 | B2 * | 9/2010 | Diemer et al. | 219/217 |
| 8,039,774 | B2 * | 10/2011 | Dubey | 219/213 |
| 8,076,613 | B2 * | 12/2011 | Raidt et al. | 219/213 |
| 8,158,231 | B2 * | 4/2012 | Hopkins et al. | 428/40.1 |
| 2003/0124292 | A1 * | 7/2003 | Unterreiter | 428/40.1 |
| 2004/0035853 | A1 * | 2/2004 | Pais | 219/548 |
| 2004/0175164 | A1 * | 9/2004 | Loktev et al. | 392/436 |
| 2005/0158503 | A1 * | 7/2005 | O'Connor | 428/40.1 |
| 2008/0210679 | A1 * | 9/2008 | Raidt et al. | 219/213 |
| 2009/0200285 | A1 * | 8/2009 | Raidt et al. | 219/213 |
| 2010/0065542 | A1 * | 3/2010 | Dubey | 219/213 |
| 2010/0175824 | A1 * | 7/2010 | Hopkins et al. | 156/249 |
| 2012/0198691 | A1 * | 8/2012 | Hopkins et al. | 29/825 |

FOREIGN PATENT DOCUMENTS

| | | |
|---|---|---|
| WO | WO 01/65891 | 9/2001 |
| WO | WO 2007/008724 | 1/2007 |
| WO | WO 2008/063173 | 5/2008 |

* cited by examiner

PLANAR HEATING ELEMENT FOR UNDERFLOOR HEATING

This application claims the benefit under 35 U.S.C. 119 of Provisional Application 61/0471916 filed Apr. 25, 2008, the disclosure of which is incorporated by reference.

This application claims the benefit under 35 U.S.C. 119 of Provisional Application 61/146,196 filed Jan. 21, 2009, the disclosure of which is incorporated by reference.

This invention relates to a heating element of the type typically used in under floor heating of tiled and other floors.

BACKGROUND OF THE INVENTION

Electrical heating elements for use under floor are widely used. In one arrangement the heating element comprises a flexible, electrically insulated polyester coated element in the form of an elongate sheet formed of top and bottom overlying layers of a polyester material where the element consists of two electrodes or bus bars running parallel the length of the element between the layers along the side edges. A row of conductive ink strips are printed onto the top surface of the bottom one of one layer of the polyester at right angles to the electrodes, contacting the electrodes thereby setting up parallel electrical heating circuits across the elongate sheet. The electrodes applied on top of the printed conductive heating strips can be formed of tinned copper and may cover a printed layer of a silver ink applied onto the edges of the bottom layer. The printed heating conductors and the bus bars are covered by the top layer.

Examples are shown in WO 2008/063173 (Seo) assigned to Carbonic Heat Corp and published 29 May 2008, WO 2007/008734 (Seo) assigned to Carbonic Heat Corp and published 18 Jan. 2007 and in WO 01/65891 (Marstiller) assigned to Calorique Ltd and published 7 Sep. 2001.

In another arrangement the heating element comprises a continuous serpentine heating wire embedded in or carried by a scrim to form a layer which can be laid over a sub-floor with the wire as part of the layer.

Such heating elements are well known and widely used for many different end uses. One end use which is preferred but not the only end use with which the present application is concerned is that of heating tile or other floors where the heating element is located between the sub-floor and the covering material with the floor adhesive applied over the heating element. The element can also be used with other types of covering layer such as concrete.

SUMMARY OF THE INVENTION

It is one object of the invention to provide an improved heating element of this general type.

According to one aspect of the invention there is provided a composite heating element comprising:

a heating element comprising a flat sheet having a first surface and a second surface each of which is defined by an insulating material;

a first conductor and a second conductor for connection thereacross of an electrical voltage;

and a conductive material extending between the first and second conductors and located between the first and second surfaces such that the voltage causes a current through the conductive material which generates heat substantially across the full extent of the sheet;

and a grounding layer laminated to the heating element and comprising a sheet of a conductive foil attached to the first surface of the flat sheet defining the heating element and a covering layer of an electrically insulating plastics material over the foil.

Preferably the heating element comprises:

a first flexible electrically insulating plastics layer defining the first surface;

a second flexible electrically insulating plastics layer defining the second surface;

the layers being connected in overlying relationship to form an elongate sheet with inside surfaces and outside surfaces and overlying side edges;

the first and second conductors comprising respective ones of two continuous electrodes each running along the element between the layers each along a respective one of the side edges and arranged for connection across a supply of a voltage;

the conductive material defining a row of conductive strips applied at right angles to the electrodes, contacting the electrodes thereby setting up parallel electrical heating circuits across the elongate sheet such that the voltage generates a heating current in the strips.

Different types of planar heating element can be used. Paper can be used as the material on which the conductors and the printed ink is carried.

Preferably the conductive strips are printed conductive ink.

Preferably the first and second layers are polyester.

Preferably there is provided a second sheet of a conductive foil attached to the second surface of the heating element for retarding fire.

Preferably there is provided a reinforcing layer on one side of the heating element which comprises an anti-fracture membrane.

Preferably the anti-fracture membrane comprises a resilient elastomeric layer.

Preferably the elastomeric layer is bitumen.

Preferably the anti-fracture membrane defines a pressure sensitive adhesive surface on an outer surface thereof.

Preferably the pressure sensitive adhesive layer is covered by a release sheet which can be peeled away to expose the adhesive.

Preferably the anti-fracture membrane is translucent.

Preferably the heating element comprises:

a first flexible electrically insulating plastics layer defining the first surface;

a second flexible electrically insulating plastics layer defining the second surface;

the layers being connected in overlying relationship to form an elongate sheet with inside surfaces and outside surfaces and overlying side edges;

the first and second conductors comprising respective ones of two continuous electrodes each running along the element between the layers each along a respective one of the side edges and arranged for connection across a supply of a voltage;

a first strip of an electrically insulating material over the first conductor defining a first slot therebetween allowing insertion into the first slot of an electrical contact of a first terminal;

and a second strip of an electrically insulating material over the second conductor defining a second slot therebetween allowing insertion into the second slot of an electrical contact of a second terminal.

Preferably there is no adhesive between the strip and the conductor.

Preferably the contact is one jaw of a clamp which bites through the layers of insulating material to engage the conductor.

Preferably the first strip is wider than the second strip so as to provide a location to receive an electrical contact of a terminal for connection to a grounding layer.

Preferably the contact is one jaw of a clamp which bites through the layers of insulating material to engage the grounding layer.

Preferably including a reinforcing layer of a fiber reinforced material defining an outermost layer on the first side of the heating element, the fiber reinforced material defining a fibrous bonding layer for engagement into a tile adhesive layer.

Preferably the metal foil layer and covering layer of a plastics material are a pre-formed laminate applied as a common laminate onto the sheet forming the heating element.

Preferably the pre-formed laminate is laminated to the heating element by a laminating layer formed of a plastics sheet carrying on each side a layer of an adhesive.

Preferably the foil thickness is less than 0.001 inch.

According to a second aspect of the invention there is provided a composite heating element comprising:

a heating element comprising a flat sheet having a first surface and a second surface each of which is defined by an insulating material;

a first conductor and a second conductor for connection thereacross of an electrical voltage;

and a conductive material extending between the first and second conductors and located between the first and second surfaces such that the voltage causes a current through the conductive material which generates heat substantially across the full extent of the sheet;

a reinforcing layer on one side of the heating element which comprises an anti-fracture membrane; and a reinforcing layer of a fiber reinforced material defining an outermost layer on the first side of the heating element, the fiber reinforced material defining a fibrous bonding layer for engagement into a tile adhesive layer.

According to a third aspect of the invention there is provided a composite heating element comprising:

a heating element comprising a flat sheet having a first surface and a second surface each of which is defined by an insulating material;

a first conductor and a second conductor for connection thereacross of an electrical voltage;

and a conductive material extending between the first and second conductors and located between the first and second surfaces such that the voltage causes a current through the conductive material which generates heat substantially across the full extent of the sheet;

wherein the heating element comprises:

a first flexible electrically insulating plastics layer defining the first surface;

a second flexible electrically insulating plastics layer defining the second surface;

the layers being connected in overlying relationship to form an elongate sheet with inside surfaces and outside surfaces and overlying side edges;

the first and second conductors comprising respective ones of two continuous electrodes each running along the element between the layers each along a respective one of the side edges and arranged for connection across a supply of a voltage;

a first strip of an electrically insulating material over the first conductor defining a first slot therebetween allowing insertion into the first slot of an electrical contact of a first terminal;

and a second strip of an electrically insulating material over the second conductor defining a second slot therebetween allowing insertion into the second slot of an electrical contact of a second terminal.

According to a further aspect of the invention there is provided a tiled floor comprising:

a sub-floor;

a layer of floor covering applied over the sub-floor;

and a heating element as defined above wherein the reinforcing layer of a fiber reinforced material is on the upper side of the heating element and fastened to the layer of floor covering by an adhesive and wherein the anti-fracture membrane is on the bottom side of the heating element and fastened to the sub-floor.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
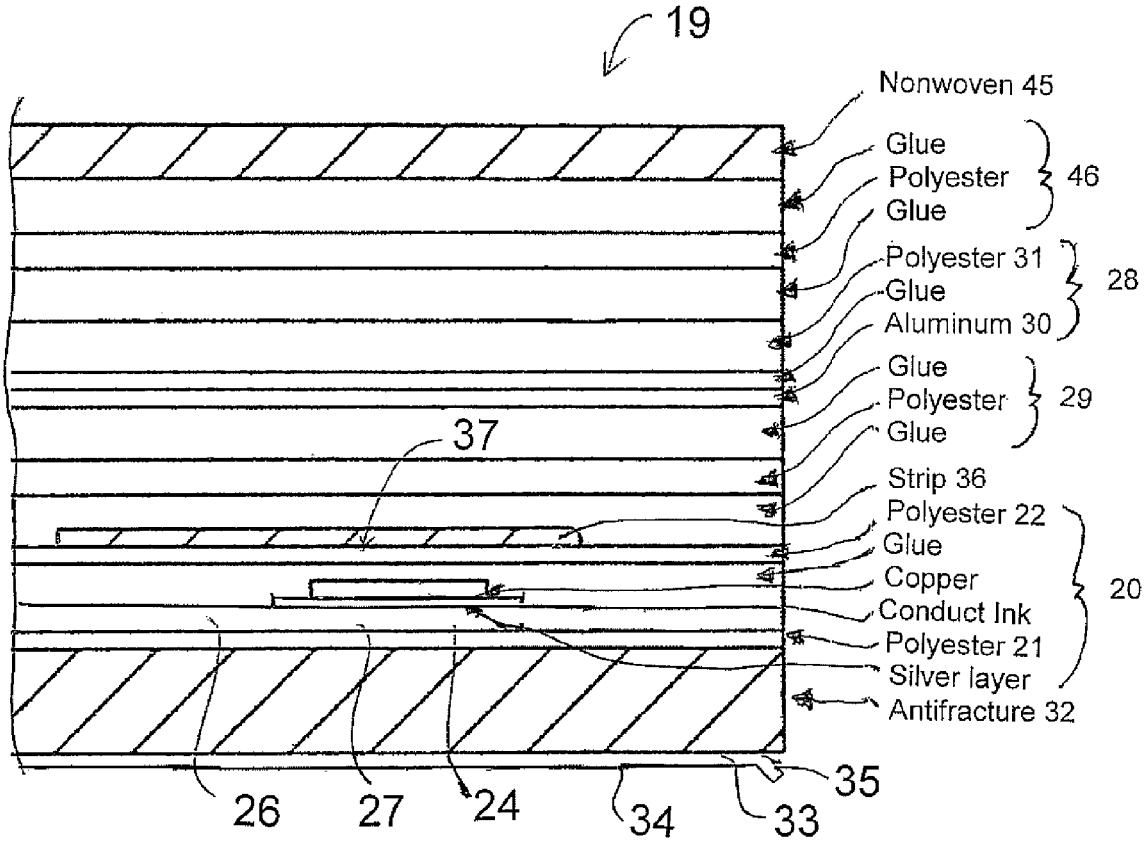
FIG. 1 is a cross section showing an end of one edge of a composite heating element according to the present invention for use with tile flooring.
Figure 2:
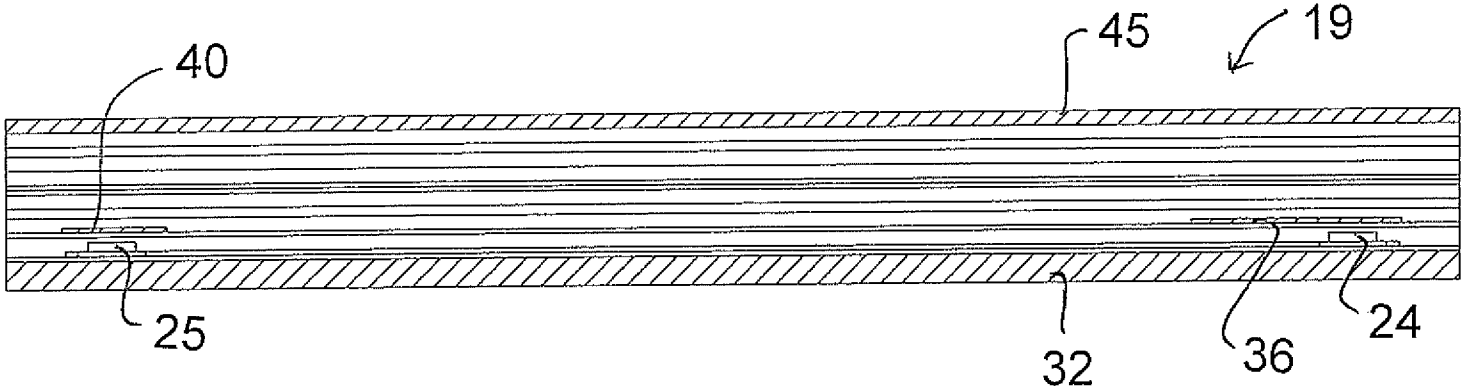
FIG. 2 is a cross section showing the whole of the edge of FIG. 1.
Figure 5:
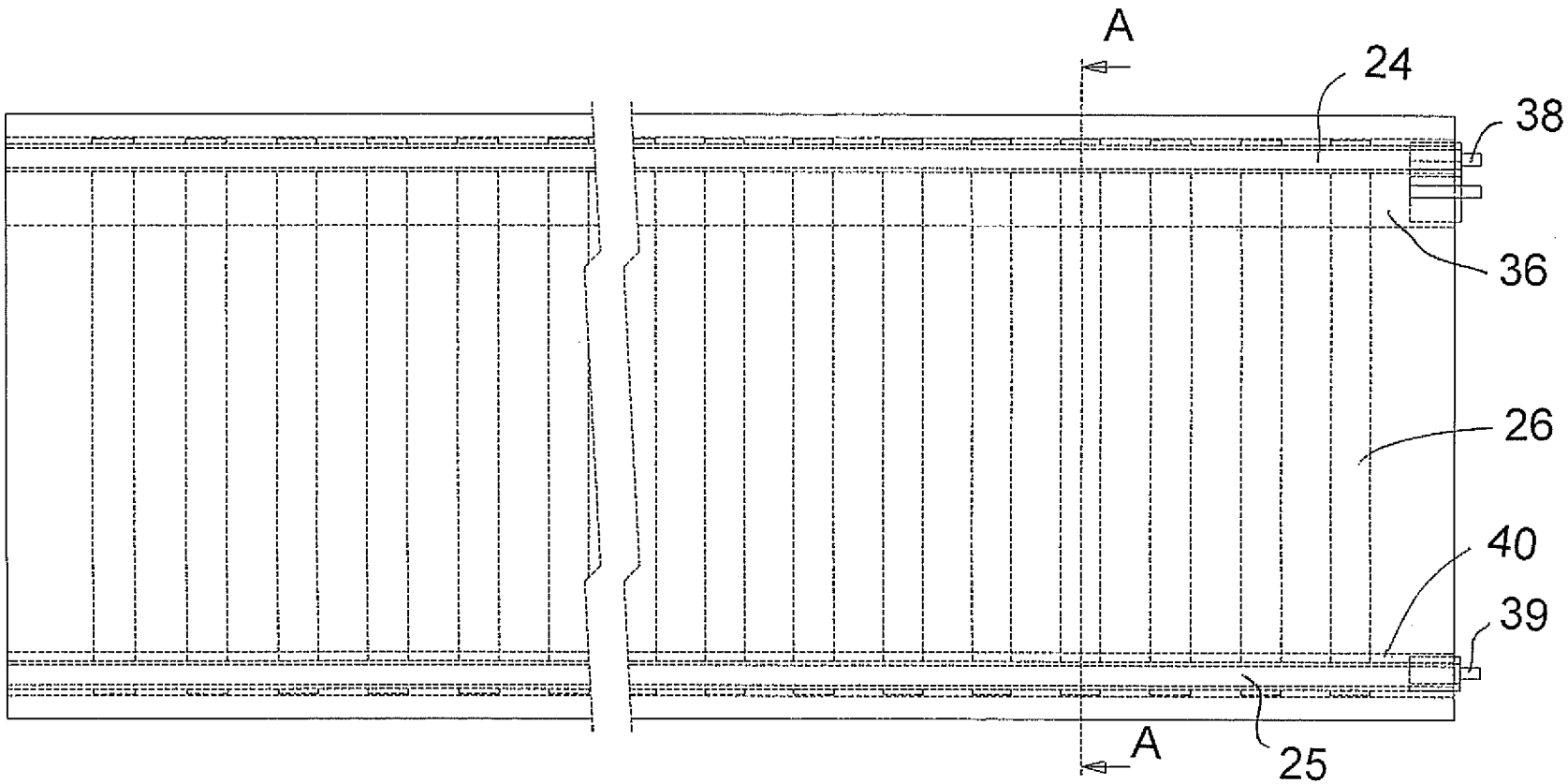
FIG. 5 is a top plan view showing the components of FIG. 1.

Turning firstly to FIGS. 1, 2 and 9 particularly, one example of a composite heating element 19 according to the present invention comprises a heating element 20 comprising a first flexible electrically insulating plastics layer 21 defining a first surface; a second flexible electrically insulating plastics layer 22 defining a second surface, the layers being connected in overlying relationship to form an elongate sheet with inside surfaces and outside surfaces and overlying side edges as shown in FIG. 5.

First and second conductors are defined by respective ones of two continuous electrodes 24 each running along the element between the layers each along a respective one of the side edges and arranged for connection across a supply of a voltage.

A conductive material extends between the first and second conductors and located between the first and second surfaces such that the voltage causes a current through the conductive material which generates heat substantially across the full extent of the sheet. The material is defined by a row of conductive strips formed by printed ink layer 26 applied at right angles to the electrodes, contacting the electrodes 24 and 25 thereby setting up parallel electrical heating circuits across the elongate sheet such that the voltage generates a heating current in the strips. A silver layer 27 is applied over the top of the printed ink to generate better contact to the bus bar or electrode 24.

A grounding layer 28 is laminated to the heating element by a laminating layer 29 and comprises a sheet of a conductive foil 30 pre-laminated to a covering layer 31 of an electrically insulating plastics material over the foil. The grounding layer 30 is laminated to the first surface 22 of the flat sheet defining the heating element 20 by the laminating layer 29 formed by a layer of plastics material carrying layers of laminating glue. Other laminating methods and materials can be used as known to persons skilled in this art.

The first and second conductors 24 and 25 comprise respective ones of two continuous copper electrodes each running along the element between the layers each along a respective one of the side edges and arranged for connection across a supply of a voltage. The first and second layers 21, 22 are polyester. There can be provided a second sheet of a conductive foil (not shown) attached to the second surface 21 of the heating element for retarding fire.

There is provided a reinforcing layer 31 on one side 21 which is the lower side of the heating element 20 which comprises an anti-fracture membrane formed of a resilient elastomeric layer such as bitumen.

The anti-fracture membrane 32 defines a pressure sensitive adhesive surface 33 on an outer surface thereof which is covered by a release sheet 34 which can be peeled away at 35 to expose the adhesive.

In an alternative arrangement, the anti-fracture membrane is translucent or at least can be seen through so as to make visible the conductive ink strips 26 so that a user can cut the element to length in a transverse direction while avoiding cutting through the strips 26.

Figure 3:
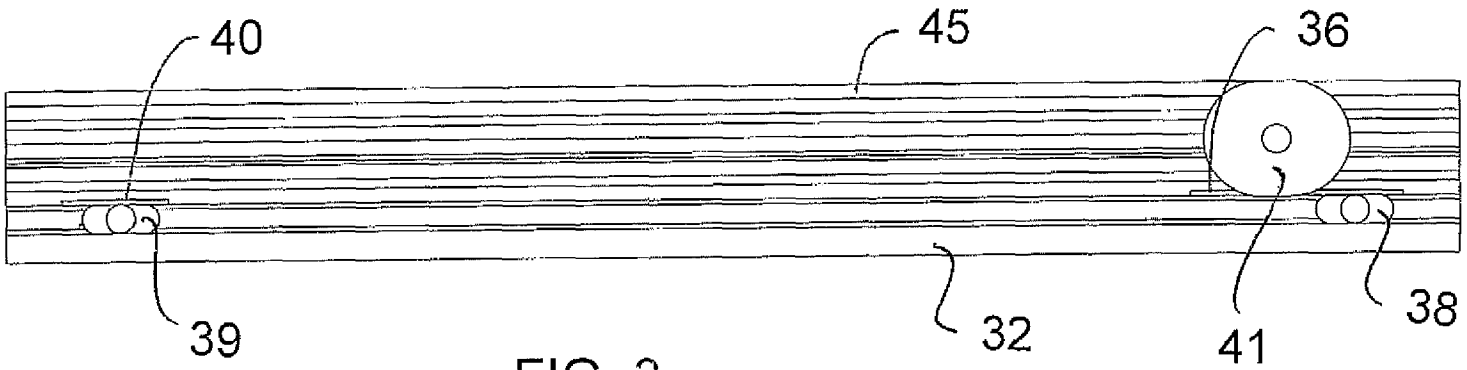
FIG. 3 is an end elevational view similar to that of FIG. 2 showing the whole edge and showing the conductor clamps engaged with the first and second conductors and the grounding layer.

A first strip 36 of an electrically insulating material is applied over the first conductor defining a first slot 37 therebetween allowing insertion into the first slot of an electrical contact (FIGS. 3, 4) of a first terminal 38;

A second strip 40 of an electrically insulating material over the second conductor defining a second slot therebetween allows insertion into the second slot of an electrical contact of a second terminal 39. The slots are formed simply by the expedient of providing no adhesive between the strip and the respective conductor. The contact is one jaw of a clamp which bites through the layers of insulating material to engage into the respective conductor.

The strip 36 is wider than the second strip 40 so as to provide a location to receive an electrical contact of a terminal 41 for connection to a grounding layer. The terminals are covered by an insulating cover as is required for electrical insulation of the installation.

Again the contact of the terminal 41 is one jaw of a clamp which bites through the layers of insulating material to engage the foil grounding layer 30. As the contact of the terminals 38 and 39 engages downwardly away from the grounding layer, they do not engage the grounding layer. As the terminal 41 is spaced along the strip 36 away from the contact 24, it does not engage the strip 24.

A reinforcing layer 45 of a fiber reinforced material is laminated by a laminating layer 46 so as to define an outermost layer on the first or upper side of the heating element, the fiber reinforced material defining a fibrous bonding layer for engagement into a tile adhesive layer.

The metal foil layer 30 and covering layer 31 of a plastics material are a pre-formed laminate applied as a common laminate onto the sheet forming the heating element with a foil thickness is less than 0.001 inch and preferably of the order of 0.00035 inch.

Thus the arrangement uses a thin gage aluminum of thickness only enough to carry the current to keep the costs down. This thin aluminum itself does not have the structural strength (tears/deforms easily) to be easily processed into our laminate structure.

The aluminum is already laminated to a polyester carrier sheet that provides all the structural strength for processing. The aluminum is anchored to the polyester using a dry cross-linked polyester based laminating adhesive. This structure is commonly used for shielding telecommunication cables.

The polyester on top and the heating element below also act as a barrier films preventing the aluminum from exposure to corrosive elements in all applications.

Figure 4:
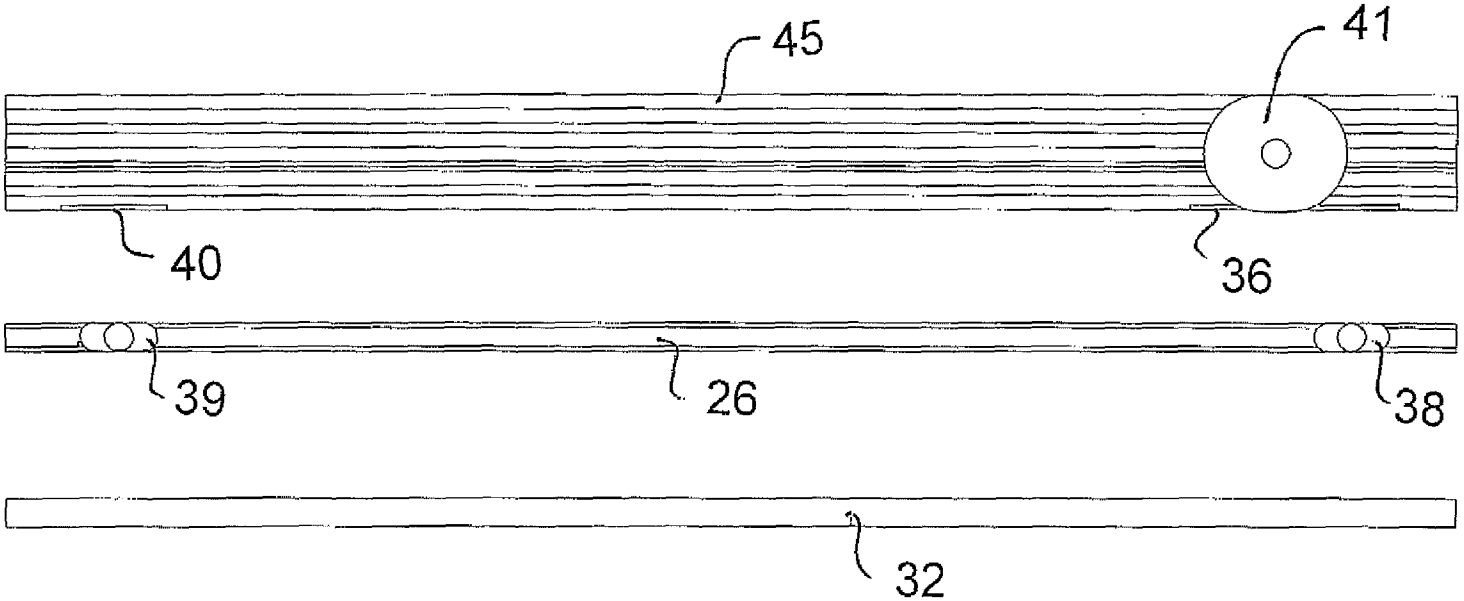
FIG. 4 is an exploded end elevational view similar to that of FIG. 3.

Referring to FIG. 4, as shown the terminal clips 38 and 39 must be attached to the assembly before adding the anti-fracture layer 32.

In an alternative arrangement (not shown) additional strips similar to the strips 36 and 40 are used to provide a similar non adhered spaces or slots similar to the slots previously described but located between the anti-fracture layer 32 and the bottom of the element 26 to attach the terminal clips 38 and 39. This allows the manufacturer to add the anti-fracture layer in line at the same time as other layers like layer 45.

The following examples of specific combinations of components are provided:

EXAMPLE 1

Nonwoven PET Scrim
19 umPE 13 umPET
19 umPE
25 um PET Film
0.6 um PET Based Adhesive
9 um Aluminum
19 umPE
13 um PET
19 um PE
51 um PET
95 um PE
Copper Bus Bar
Conductive Ink
114 um PET
762 um Bitumen

EXAMPLE 2

25 um PET Film
0.6 um PET Based Adhesive
9 um Aluminum
19 um PE
13 um PET
19 um PE
51 um PET
95 um PE
Copper Bus Bar
Conductive Ink
114 um PET

EXAMPLE 3

25 um PET film
0.6 um PET Based Adhesive
9 um Aluminum
19 um PE
23 um PET
19 um PE
51 um PET
95 um PE
Copper Bus Bar
Conductive Ink
114 um PET The Heating Element comprises a flexible, electrically insulated polyester coated element. The element consists of two electrodes or bus bars running parallel the length of the element. A conductive ink strip is printed onto the polyester at right angles to the electrodes, crossing the electrodes thereby setting up an electrical circuit. The conductive ink is resistive as per desired watts required per square foot (meter). Each bar of ink is calculated in resistance (Ohms) and is part of the heater. The entire element is covered by another electrically insulated polyester film.

While a third bus bar can be used to carry ground current in the event of a fault, this can be omitted in most circumstances since the current values which generate roughly 10 to 12 watts per square foot which is typical are insufficient to require the additional conductive material and the foil will suffice. The foil may be coated on both sides with a plastics insulating material (not shown) and in the event that the bus bar is not used, it is only necessary to connect to the ground layer at a single point by stripping the plastic coating layer on one side. The bus bar can be located underneath or on top of the foil. The top reinforcing layer of a woven or non-woven scrim can be of the type known as Collbond.

In a further embodiment (not shown) the top reinforcing layer of woven or non-woven scrim and the bottom anti-fracture membrane can be used in relation to a wire element type construction where the element is grounded with a grounding sheet or not grounded. The wire of the element is contained in a scrim.

A further example (not shown) includes a grounding layer and includes a second foil layer on the opposed side to the grounding layer for purposes of fire retardance.

The anti-fracture membrane may incorporate the heating element as part of the membrane or it may be separately applied depending on the manufacturer.

The arrangement can be used in a tiled floor comprising a sub-floor; a layer of tiles applied over the sub-floor; and a heating element where the reinforcing layer of a fiber reinforced material is on the upper side of the heating element and fastened to the layer of tiles by a tile adhesive and the anti-fracture membrane is on the bottom side of the heating element and fastened to the sub-floor.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A composite heating element comprising:

a heating element comprising a flat sheet having a first surface and a second surface each of which is defined by an insulating material;

a first conductor and a second conductor for connection thereacross of an electrical voltage;

and a conductive material extending between the first and second conductors and located between the first and second surfaces such that the voltage causes a current through the conductive material which generates heat substantially across the full extent of the sheet;

wherein the heating element comprises:

a first flexible electrically insulating plastics layer defining the first surface;

a second flexible electrically insulating plastics layer defining the second surface;

the layers being connected in overlying relationship to form an elongate sheet with inside surfaces and outside surfaces and overlying side edges;

the first and second conductors comprising respective ones of two continuous electrodes each running along the element between the layers each along a respective one of the side edges and arranged for connection across a supply of a voltage;

a first strip of an electrically insulating material applied over the first conductor which defines a first slot between the first strip and the first conductor allowing insertion into the first slot between the first strip and the first conductor of an electrical contact of a first terminal;

and a second strip of an electrically insulating material over the second conductor defining a second slot between the second strip and the second conductor allowing insertion into the second slot between the second strip and the second conductor of an electrical contact of a second terminal.

2. The heating element according to claim 1 wherein the conductive material defines a row of conductive strips applied at right angles to the conductors, contacting the conductors thereby setting up parallel electrical heating circuits across the elongate sheet such that the voltage generates a heating current in the strips.

3. The composite heating element according to claim 1 including a grounding layer laminated to the heating element over the first and second strips so that the first and second strips separate the grounding layer from the heating element.

4. The composite heating element according to claim 3 wherein the grounding layer comprises a sheet of a conductive foil and a covering layer of an electrically insulating plastics material laminated to the foil by a layer of adhesive therebetween;

the grounding layer being laminated to the first surface of the flat sheet defining the heating element by a layer of adhesive therebetween which layer covers the grounding layer;

wherein the conductive foil and covering layer of a plastics material are a pre-formed laminate applied as a common laminate onto the first surface of the flat sheet defining the heating element.

5. The heating element according to claim 2 wherein the conductive strips are printed conductive ink.

6. The heating element according to claim 4 wherein there is provided a second sheet of a conductive foil attached to the second surface of the heating element for retarding fire.

7. The heating element according to according to claim 1 wherein there is provided a reinforcing layer on one side of the heating element which comprises an anti-fracture membrane.

8. The heating element according to according to claim 7 wherein the anti-fracture membrane comprises a resilient elastomeric layer.

9. The heating element according to claim 8 wherein the elastomeric layer is bitumen.

10. The heating element according to claim 8 wherein the anti-fracture membrane defines a pressure sensitive adhesive surface on an outer surface thereof.

11. The heating element according to claim 10 wherein the pressure sensitive adhesive layer is covered by a release sheet which can be peeled away to expose the adhesive.

12. The heating element according to claim 8 wherein the anti-fracture membrane is translucent.

13. The heating element according to according to claim 1 wherein there is no adhesive between the strip and the conductor.

14. The heating element according to according to claim 1 wherein the first strip is wider than the second strip so as to provide a location to receive an electrical contact of a terminal for connection to a grounding layer.

15. The heating element according to according to claim 1 including a reinforcing layer of a fiber reinforced material defining an outermost layer on the first side of the heating element, the fiber reinforced material defining a fibrous bonding layer for engagement into a tile adhesive layer.

16. The heating element according to according to claim 4 wherein the pre-formed laminate is laminated to the heating element by a laminating layer formed of a plastics sheet carrying on each side a layer of an adhesive.

17. The heating element according to according to claim 4 wherein the foil thickness is less than 0.001 inch.

18. The composite heating element according to claim 1 wherein there is provided a reinforcing layer on the first surface of the heating element which comprises an anti-fracture membrane of a resilient elastomeric material with a pressure sensitive adhesive surface on an outer surface thereof covered by a release sheet which can be peeled away to expose the adhesive.

19. The heating element according to according to claim 18 including a reinforcing layer of a fiber reinforced material defining an outermost layer on the second surface of the heating element, the fiber reinforced material defining a fibrous bonding layer for engagement into a tile adhesive layer.

* * * * *